US010502001B2

(12) United States Patent
Nguyen et al.

(10) Patent No.: US 10,502,001 B2
(45) Date of Patent: Dec. 10, 2019

(54) EARTH-BORING TOOLS CARRYING FORMATION-ENGAGING STRUCTURES

(71) Applicant: Baker Hughes, a GE company, LLC, Houston, TX (US)

(72) Inventors: Don Quy Nguyen, Houston, TX (US); Juan Miguel Bilen, The Woodlands, TX (US); Steven C. Russell, Houston, TX (US); Kenneth R. Evans, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 320 days.

(21) Appl. No.: 14/933,908

(22) Filed: Nov. 5, 2015

(65) Prior Publication Data

US 2017/0130534 A1 May 11, 2017

(51) Int. Cl.
*E21B 10/633* (2006.01)
*E21B 10/55* (2006.01)

(52) U.S. Cl.
CPC ..... *E21B 10/633* (2013.01); *E21B 10/55* (2013.01)

(58) Field of Classification Search
CPC ..... E21B 2010/624; E21B 2010/622; E21B 10/633; E21B 10/627; E21B 10/62; E21B 10/20; E21B 10/04
See application file for complete search history.

(56) References Cited

U.S. PATENT DOCUMENTS 1,461,554 A 7/1923 Raffay
1,902,711 A 3/1933 Kulp et al.
3,148,741 A 9/1964 Holsing
(Continued)

FOREIGN PATENT DOCUMENTS

WO 2012149120 A2 11/2012

OTHER PUBLICATIONS

Bilen et al., U.S. Appl. No. 14/272,369 entitled Formation-Engaging Assemblies, Earth-Boring Tools Including Such Assemblies and Related Methods, filed May 7, 2014.
(Continued)

*Primary Examiner* — Robert E Fuller
*Assistant Examiner* — Lamia Quaim
(74) *Attorney, Agent, or Firm* — TraskBritt

(57) ABSTRACT

An earth-boring tool includes a blade located on a body of the earth-boring tool with a pocket formed in an exposed outer surface of the blade. A formation-engaging structure is affixed within the pocket. The formation-engaging structure includes a distal end, a proximal end and a tapered sidewall therebetween. The distal end of the formation-engaging structure includes a formation-engaging surface. The tapered sidewall engages a tapered inner surface of the pocket. The tapered sidewall of the formation-engaging structure and the tapered inner surface of the pocket are each sized and configured to provide an interference fit between the formation-engaging structure and the pocket of the blade. In additional embodiments, instead of retention by interference fit, the formation-engaging structure is retained to the blade by a threaded fastener threaded within a tapped bore extending through the blade. The threaded fastener is received within a receiving formation of the formation-engaging structure.

18 Claims, 5 Drawing Sheets

(56) References Cited

U.S. PATENT DOCUMENTS

| | | | | |
|---|---|---|---|---|
| 3,672,455 | A | 6/1972 | Foster | |
| 3,693,736 | A | 9/1972 | Gardner | |
| 3,760,894 | A | 9/1973 | Pitifer | |
| 3,765,496 | A | 10/1973 | Flores et al. | |
| 3,805,364 | A | 4/1974 | Gardner | |
| 3,999,620 | A | 12/1976 | Watson et al. | |
| 4,266,895 | A * | 5/1981 | Lewis | B23B 31/1074 279/52 |
| 4,271,917 | A | 6/1981 | Sahley | |
| 4,465,148 | A | 8/1984 | Morris et al. | |
| 4,542,943 | A | 9/1985 | Montgomery et al. | |
| 4,679,858 | A | 7/1987 | Tank | |
| 4,711,144 | A | 12/1987 | Barr et al. | |
| 4,838,366 | A | 6/1989 | Jones | |
| 5,096,344 | A | 3/1992 | Fischer et al. | |
| 5,333,378 | A | 8/1994 | Sjobom | |
| 5,560,440 | A | 10/1996 | Tibbitts | |
| 5,678,645 | A | 10/1997 | Tibbitts et al. | |
| 5,906,245 | A | 5/1999 | Tibbitts et al. | |
| 6,142,250 | A | 11/2000 | Griffin et al. | |
| 6,170,576 | B1 * | 1/2001 | Brunnert | E21B 10/46 166/298 |
| 6,427,791 | B1 | 8/2002 | Glowka et al. | |
| 6,883,623 | B2 | 4/2005 | McCormick et al. | |
| 6,920,944 | B2 | 7/2005 | Eppink et al. | |
| 6,971,459 | B2 | 12/2005 | Raney | |
| 7,419,016 | B2 | 9/2008 | Hall et al. | |
| 7,424,922 | B2 | 9/2008 | Hall et al. | |
| 7,533,737 | B2 | 5/2009 | Hall et al. | |
| 7,571,780 | B2 | 8/2009 | Hall et al. | |
| 7,641,002 | B2 | 1/2010 | Hall et al. | |
| 7,730,975 | B2 | 6/2010 | Hall et al. | |
| 7,814,997 | B2 | 10/2010 | Aliko et al. | |
| 7,849,939 | B2 | 12/2010 | Downton et al. | |
| 7,946,656 | B2 | 5/2011 | Hall et al. | |
| 8,007,050 | B2 | 8/2011 | Hall et al. | |
| 8,087,479 | B2 | 1/2012 | Kulkarni et al. | |
| 8,141,665 | B2 | 3/2012 | Ganz | |
| 8,172,008 | B2 | 5/2012 | Dykstra et al. | |
| 8,281,882 | B2 | 10/2012 | Hall et al. | |
| 8,511,946 | B2 | 8/2013 | Woodruff et al. | |
| 8,950,517 | B2 | 2/2015 | Hall et al. | |
| 9,140,074 | B2 | 9/2015 | Schwefe et al. | |
| 9,181,756 | B2 | 11/2015 | Schwefe et al. | |
| 9,255,449 | B2 | 2/2016 | Schwefe et al. | |
| 9,359,826 | B2 | 6/2016 | Do et al. | |
| 9,399,892 | B2 | 7/2016 | Do et al. | |
| 9,551,190 | B2 | 1/2017 | Hiwasa et al. | |
| 9,708,859 | B2 | 7/2017 | Jain et al. | |
| 9,759,014 | B2 | 9/2017 | Do et al. | |
| 9,932,780 | B2 | 4/2018 | Spencer et al. | |
| 2005/0241858 | A1 * | 11/2005 | Eppink | E21B 10/325 175/325.1 |
| 2006/0277738 | A1 * | 12/2006 | Hume | B25B 27/023 29/426.5 |
| 2008/0236900 | A1 | 10/2008 | Cooley et al. | |
| 2009/0158898 | A1 | 6/2009 | Sherwood, Jr. et al. | |
| 2010/0276200 | A1 | 11/2010 | Schwefe et al. | |
| 2010/0314176 | A1 * | 12/2010 | Zhang | E21B 10/573 175/383 |
| 2011/0114393 | A1 | 5/2011 | Dolan et al. | |
| 2011/0297454 | A1 | 12/2011 | Shen et al. | |
| 2012/0043138 | A1 * | 2/2012 | Myers | E21B 10/633 175/428 |
| 2012/0054998 | A1 | 3/2012 | Tschida et al. | |
| 2013/0180784 | A1 | 7/2013 | Esko et al. | |
| 2014/0191563 | A1 | 7/2014 | Elfgen | |
| 2015/0028656 | A1 | 1/2015 | Sollami | |
| 2015/0322726 | A1 | 11/2015 | Bilen et al. | |
| 2015/0330153 | A1 | 11/2015 | Miller et al. | |
| 2018/0179826 | A9 | 6/2018 | Jain et al. | |

OTHER PUBLICATIONS

Do et al. U.S. Appl. No. 14/272,360 entitled Formation-Engaging Structures Having Retention Features, Earth-Boring Tools Including Such Structures and Related Methods, filed May 7, 2014.

Miller et al., U.S. Appl. No. 14/276,587 entitled Earth-Boring Tools Including Bearing Element Assemblies, and Related Methods, filed May 13, 2014.

* cited by examiner

EARTH-BORING TOOLS CARRYING FORMATION-ENGAGING STRUCTURES

CROSS-REFERENCE TO RELATED APPLICATIONS

The subject matter of this application is related to the subject matter of U.S. patent application Ser. No. 14/272,360, filed on May 7, 2014 now U.S. Pat. No. 9,359,826, issued Jun. 7, 2016, in the name of Van Do et al., to the subject matter of U.S. patent application Ser. No. 14/272,369, filed on May 7, 2014 now U.S. Pat. No. 9,476,257, issued Oct. 25, 2016, in the name of Bilen et al., and to the subject matter of U.S. application Ser. No. 14/276,587, filed on May 13, 2014, in the name of Miller et al., the entire disclosure of each of which is incorporated herein by this reference.

TECHNICAL FIELD

Embodiments of the present disclosure relate to earth-boring tools carrying formation-engaging structures and, more particularly, to retention features retaining the formation-engaging structures on the earth-boring tools.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutters are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated.

A plurality of cutting elements is positioned on each of the blades. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements or cutters. The plurality of PDC cutting elements may be fixed within cutting element pockets formed in rotationally leading surfaces of each of the blades. Conventionally, a bonding material, such as a braze alloy, may be used to secure the cutting elements to the bit body.

Some earth-boring tools may also include bearing elements that may limit the depth-of-cut (DOC) of the cutting elements, protect the cutting elements from excessive contact with the formation, enhance (e.g., improve) dynamic stability of the tool, or perform other functions or combinations of functions. The bearing elements conventionally are located entirely rotationally behind associated leading cutting elements to limit DOC as the bearing elements contact and ride on an underlying earth formation, although bearing elements rotationally leading cutting elements are also known.

BRIEF SUMMARY

In one embodiment of the disclosure, an earth-boring tool comprises a blade located on a body of the earth-boring tool with a pocket formed in an exposed outer surface of the blade. The earth-boring tool includes a formation-engaging assembly affixed within the pocket. The formation-engaging assembly comprises a formation-engaging structure disposed within a holder. The holder has a distal end, a proximal end and a tapered sidewall therebetween. The tapered sidewall engages a tapered inner surface of the pocket. The tapered sidewall of the holder and the tapered inner surface of the pocket are each sized and configured to provide an interference fit between the holder and the pocket of the blade. A formation-engaging surface of the formation-engaging structure extends from the distal end of the holder.

In another embodiment of the disclosure, an earth-boring tool comprises a blade located on a body of the earth-boring tool with a pocket formed in an exposed outer surface of the blade. A formation-engaging structure is affixed within the pocket. The formation-engaging structure has a distal end, a proximal end and a tapered sidewall therebetween. The distal end of the formation-engaging structure includes a formation-engaging surface. The tapered sidewall engages a tapered inner surface of the pocket. The tapered sidewall of the formation-engaging structure and the tapered inner surface of the pocket are each sized and configured to provide an interference fit between the formation-engaging structure and the pocket of the blade.

In yet another embodiment of the disclosure, an earth-boring tool comprises a blade located on a body of the earth-boring tool with a pocket formed in an exposed outer surface of the blade. A tapped bore extends from at least one of a rotationally leading surface and a rotationally trailing surface of the blade to the pocket. The earth-boring tool includes a formation-engaging structure affixed within the pocket. The formation-engaging structure has a distal end, a proximal end and a sidewall therebetween. The distal end of the formation-engaging structure includes a formation-engaging surface. A receiving formation is formed in the sidewall of the formation-engaging structure. A threaded fastening element is threaded within the tapped bore such that a first end of the threaded fastening element engages the receiving formation of the formation-engaging structure. The threaded fastening element retains the formation-engaging structure within the pocket.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of disclosed embodiments may be more readily ascertained from the following description when read with reference to the accompanying drawings, in which:

DETAILED DESCRIPTION

The illustrations presented herein are not actual views of any particular material, cutting element, formation-engaging structure, or earth-boring tool, but are merely idealized representations employed to describe embodiments of the present disclosure. Additionally, elements common between figures may retain the same numerical designation.

As used herein, the term "earth-boring tool" means and includes any tool used to remove formation material and form a bore (e.g., a wellbore) through the formation by way of removing the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools, etc.

Figure 1:
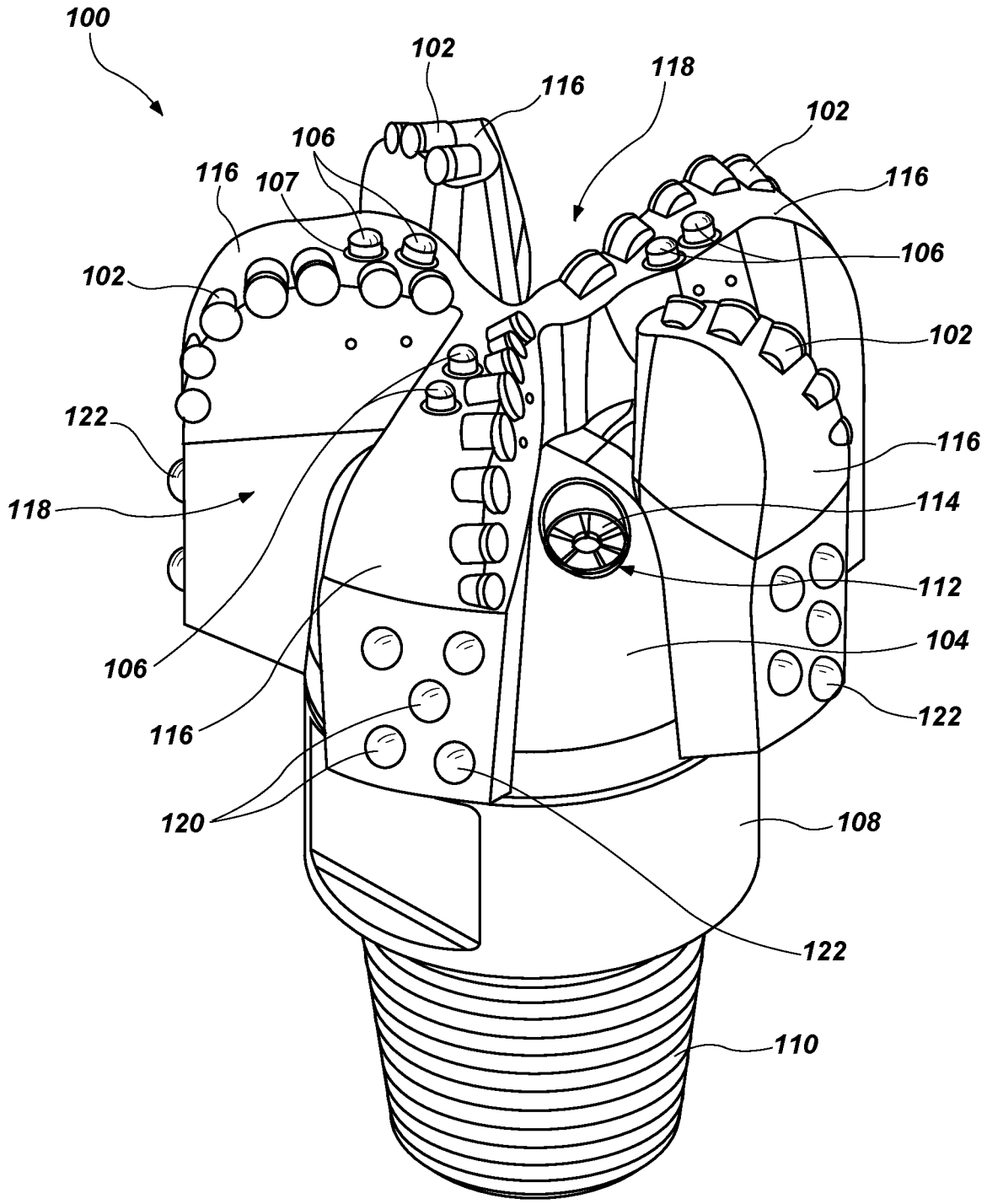
FIG. 1 is a perspective view of an earth-boring drill bit with formation-engaging structures, according to an embodiment of the present disclosure.

FIG. 1 is a perspective view of an embodiment of an earth-boring tool 100 of the present disclosure. The earth-boring tool 100 of FIG. 1 is configured as an earth-boring rotary drill bit, although other types of earth-boring tools are within the scope of the present disclosure. The earth-boring tool 100 may comprise a plurality of cutting elements 102 affixed to a body 104 of the earth-boring tool 100. The earth-boring tool 100 may include one or more formation-engaging structures 106 affixed to formation-engaging structure holders 107 that are attached to the body 104. The formation-engaging structures 106 may comprise, for example, cutting elements, bearing elements, or wear knots. The formation-engaging structures 106 and/or the holders 107 may include features that interact with features of the earth-boring tool 100 to facilitate retention of the formation-engaging structures 106 within the earth-boring tool 100 and removal of the formation-engaging structures 106 from the earth-boring tool 100, as discussed in further detail below.

The body 104 of the earth-boring tool 100 may be secured to a shank 108 having a threaded connection portion 110, which may conform to industry standards, such as those promulgated by the American Petroleum Institute (API), for attaching the earth-boring tool 100 to a drill string (not shown).

The body 104 may include internal fluid passageways that extend between fluid ports 112 at the face of the body 104 and a longitudinal bore that extends through the shank 108 and partially through the body 104. Nozzle inserts 114 may be secured within the fluid ports 112 of the internal fluid passageways. The body 104 may further include a plurality of blades 116 that are separated by fluid courses 118, which may be referred to in the art as "junk slots." In some embodiments, the body 104 may include gage wear plugs 120, wear knots 122, or both.

Each formation-engaging structure 106 may be positioned on a blade 116 to rotationally trail at least one cutting element 102, as shown in FIG. 1. In some embodiments, the formation-engaging structures 106 may be positioned to rotationally lead cutting elements 102 located on a rotationally trailing blade or optionally on the same blade 116, or the formation-engaging structures 106 may be disposed at positions intermediate at least two cutting elements 102 along a radial axis. The formation-engaging structures 106 may be formed partially or fully of a wear-resistant material, such as cemented tungsten carbide, or distal ends thereof may comprise a wear-resistant material, such as cemented tungsten carbide, or a superabrasive material, such as polycrystalline diamond or cubic boron nitride. The wear-resistant material may comprise a coating or particles of the wear-resistant material over an entirety of the distal end, or inserts of the wear-resistant material embedded in a surface of the distal end. In some embodiments, the formation-engaging structures 106 may comprise a volume of superabrasive material, such as polycrystalline diamond, at the distal ends thereof disposed over substrates of wear-resistant material, such as cemented tungsten carbide.

Figure 2:
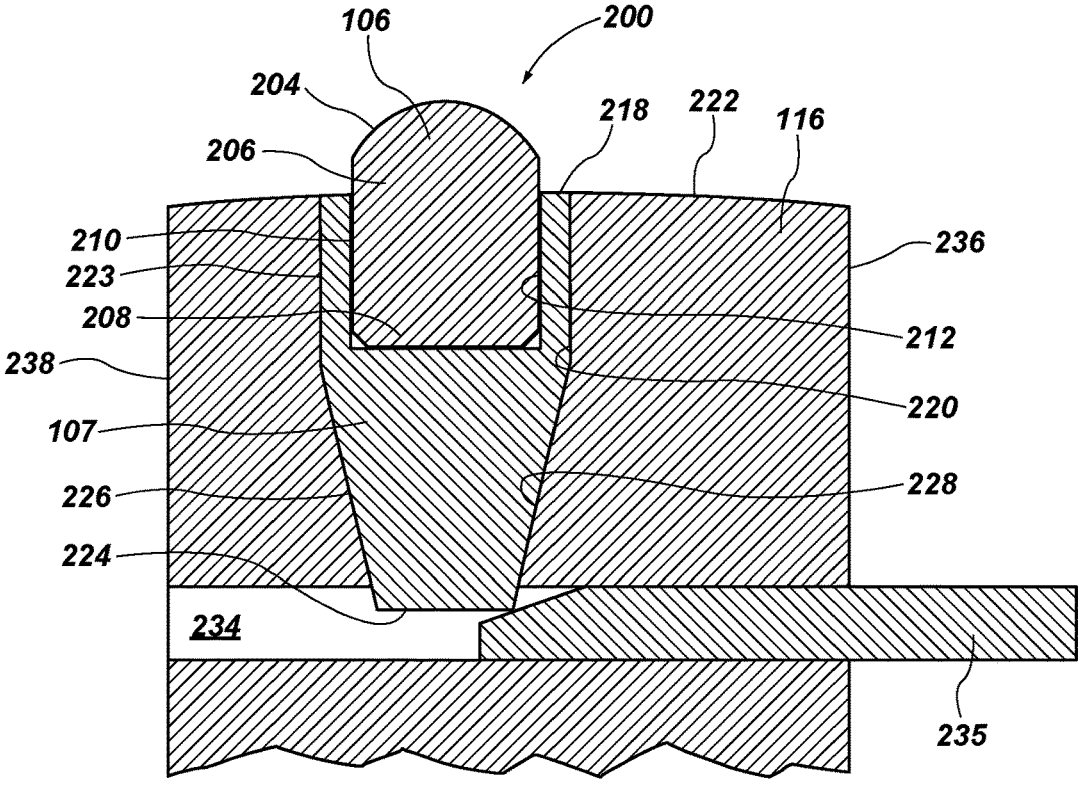
FIG. 2 is a side, cross-sectional view of a formation-engaging structure carried by a holder that is attached by interference fit to a blade of an earth-boring tool, according to an embodiment of the present disclosure.

FIG. 2 illustrates a side, cross-sectional view of a blade 116 carrying the formation-engaging structure 106 and the formation-engaging structure holder 107 shown in FIG. 1. The formation-engaging structure 106 and the holder 107 may collectively be termed a "formation-engaging assembly" 200. The formation-engaging structure 106 may include a formation-engaging surface 204 at a distal end 206 opposite a proximal end 208 with a side surface 210 of the formation-engaging structure 106 extending between the distal end 206 and the proximal end 208. The side surface 210 of the formation-engaging structure 106 may also be characterized as a sidewall. The formation-engaging surface 204 may comprise a convex shape, such as a shape generally defined by a portion of a sphere. In some embodiments, the formation-engaging surface 204 may be substantially hemispherical or have an ovoid shape. Such a formation-engaging structure 106 may be referred to in the art as an "insert." In some embodiments, the formation-engaging surface 204 may be generally conical or chisel-shaped. In some embodiments, the formation-engaging surface 204 may comprise an asymmetrical shape. In the embodiment of FIG. 2, the side surface 210 of the formation-engaging structure 106 may comprise a circular transverse cross-sectional shape, imparting to the side surface 210 a substantially cylindrical shape. In other embodiments, the cross-sectional shape may include, without limitation, other shapes, such as ellipses, polygons, and shapes including both arcuate and rectilinear portions.

The formation-engaging structure holder 107 may comprise a metal alloy, such as a steel alloy, or may comprise a cemented tungsten carbide matrix material, by way of non-limiting example. The holder 107 may include a receptacle 212 for accepting at least a portion of the side surface 210 of the formation-engaging structure 106. The sidewall of the receptacle 212 may comprise a cross-sectional shape and size similar to the cross-sectional shape and size of the side surface 210 of the formation-engaging structure 106, such that the formation-engaging structure 106 fits tightly within the receptacle 212. In some embodiments, the sizes of the cross-sectional shapes of the receptacle 212 and the side surface 210 may be chosen to provide a clearance between the side surface 210 and a sidewall of the receptacle 212 to facilitate affixing the formation-engaging structure 106 within the holder 107, with, for example, a braze or adhesive.

As a non-limiting example, the formation-engaging structure 106 may be brazed within the receptacle 212 or attached within the receptacle mechanically or with an adhesive, as more fully described in U.S. patent application Ser. No. 14/272,369, filed May 7, 2014, which has been incorporated herein by reference. The receptacle 212 may extend from a distal end 218 of the holder 107 a predetermined depth into the holder 107, as also more fully described in U.S. patent application Ser. No. 14/272,369.

The formation-engaging assembly 200 may be affixed to the blade 116 within a pocket 220 formed in an exposed outer surface 222 of the blade 116. The holder 107 may have a side surface 223 extending between the distal end 218 and a proximal end 224 of the holder 107. The side surface 223 of the holder 107 may also be characterized as a sidewall. The side surface 223 of the holder 107 may comprise a cross-sectional shape and size similar to the cross-sectional shape and size of an inner surface of the pocket 220, such that the holder 107 fits tightly within the receptacle pocket 220. A portion 226 of the side surface 223 of the holder 107 may be tapered and may be sized and configured to mate with a tapered inner surface 228 of the pocket 220 in a manner providing an interference fit between the holder 107 and the pocket 220. The holder 107 may be inserted into the pocket 220 and subsequently driven into the pocket 220 by a hammer and punch, a press, such as a hydraulic press, or another suitable tool, until the holder 107 is fully disposed within the pocket 220 and retained by an interference fit between the tapered portion 226 of the side surface 223 of the holder 107 and the tapered inner surface 228 of the pocket 220. In other embodiments, the holder 107 may be shrink fitted within the pocket 220 (alternatively, or, in addition to the foregoing insertion methods). Accordingly, the radius of the tapered portion 226 of the holder 107 may be slightly larger than the radius of the tapered inner surface 228 of the pocket 220 at corresponding longitudinal positions of the tapered portion 226 of the holder 107 and the tapered inner surface 228 of the pocket 220. It is to be appreciated that the holder 107 may be affixed within the pocket 220 prior to or after the formation-engaging structure 106 is attached within the receptacle 212 of the holder 107.

As shown in FIG. 2, the holder 107 may be pressed into the pocket 220 until the distal end 218 of the holder 107 is flush with the exposed outer surface 222 of the blade 116. However, in other embodiments (not shown), the distal end 218 of the holder 107 may be upstanding or recessed from the exposed outer surface 222 of the blade 116 when the holder 107 is affixed within the pocket 220

With continued reference to FIG. 2, the blade 116, the pocket 220 and the holder 107 may include features configured to facilitate removal of the formation-engaging assembly 200 from the blade 116. For example, a bore 234 may extend through the blade 116 in a manner such that the proximal end 224 of the holder 107 extends within the bore 234. The bore 234 may be sized and oriented such that an operator may use a tool, such as a tapered punch 235, to drive the formation-engaging assembly 200 out of the pocket 220. It is to be appreciated that other tools for removing the formation-engaging assembly 200 from the pocket 220 are within the scope of the present embodiments, including a drift pin or even fluid pressure exerted within the bore 234 by one or more fluid pressure transferring mediums. As shown, the bore 234 may extend entirely through the blade 116 (i.e., from the rotationally leading surface 236 to the rotationally trailing surface 238 of the blade 116). In other embodiments (not shown), the bore 234 may be a blind bore that extends from either the rotationally leading surface 236 of the blade 116 or the rotationally trailing surface 238 of the blade 116 and underlies the proximal end 224 of the holder 107. It is to be appreciated that the size and orientation of the bore 234 may be varied based on a number of factors that may affect removal of the formation-engaging assembly 200 from the pocket 220, such as, by way of non-limiting example, the design of the blade 116 and/or the design of the formation-engaging assembly 200.

Figure 3:
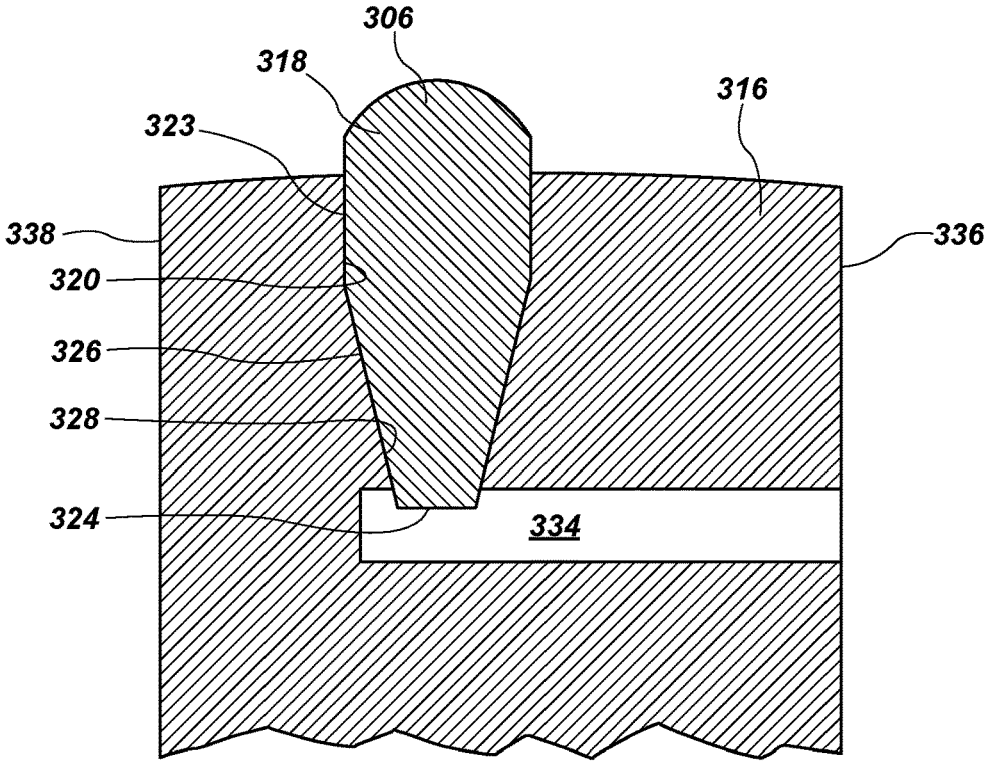
FIG. 3 is a side, cross-sectional view of a formation-engaging structure directly attached by interference fit to a blade of an earth-boring tool, according to an embodiment of the present disclosure.

Referring now to FIG. 3, a formation-engaging structure 306 may be attached within a pocket 320 of a blade 316 by interference fit directly between the formation-engaging structure 306 and the pocket 320. In such embodiments, the formation-engaging structure 306 may have a side surface 323 extending between a distal end 318 and a proximal end 324 of the formation-engaging structure 306. The side surface 323 of the formation-engaging structure 306 may also be characterized as a sidewall. The side surface 323 of the formation-engaging structure 306 may comprise a cross-sectional shape and size similar to the cross-sectional shape and size of an inner surface of the pocket 320, such that the formation-engaging structure 306 fits tightly within the pocket 320. A portion 326 of the side surface 323 of the formation-engaging structure 306 may be tapered and may be sized and configured to mate with a tapered inner surface 328 of the pocket 320 in a manner providing an interference fit between the formation-engaging structure 306 and the pocket 320. The formation-engaging structure 306 may be inserted into the pocket 320 and subsequently driven into the pocket 320 by a hammer and punch, a press, such as a hydraulic press, or another suitable tool, until the formation-engaging structure 306 is fully disposed within the pocket 320 and retained by an interference fit between the tapered portion 326 of the side surface 323 of the formation-engaging structure 306 and the tapered inner surface 328 of the pocket 320, similarly as previously described with respect to the embodiment of FIG. 2.

As with the embodiment shown in FIG. 2, the blade 316, the pocket 320 and the formation-engaging structure 306 of FIG. 3 may include features configured to facilitate removal of the formation-engaging structure 306 from the blade 316. For example, a bore 334 may extend through the blade 316 and may underlie the formation-engaging structure 306 such that the proximal end 324 of the formation-engaging structure 306 extends within the bore 334. The bore 334 is shown in FIG. 3 as a blind bore extending from the rotationally leading surface 336 of the blade 316; however, it is to be understood that the bore 334 may be a blind bore extending from the rotationally trailing surface 338 of the blade 316 or may be a through bore. The bore 334 may be sized and oriented such that an operator may use a tool, such as a tapered punch (FIG. 2), to drive the formation-engaging structure 306 out of the pocket 320, as previously described. It is to be appreciated that other embodiments for removing the formation-engaging structure 306 from the pocket 320 are within the scope of the present disclosure, including a drift pin or even utilizing fluid pressure exerted within the bore 234 by one or more fluid pressure transferring mediums.

Figure 4:
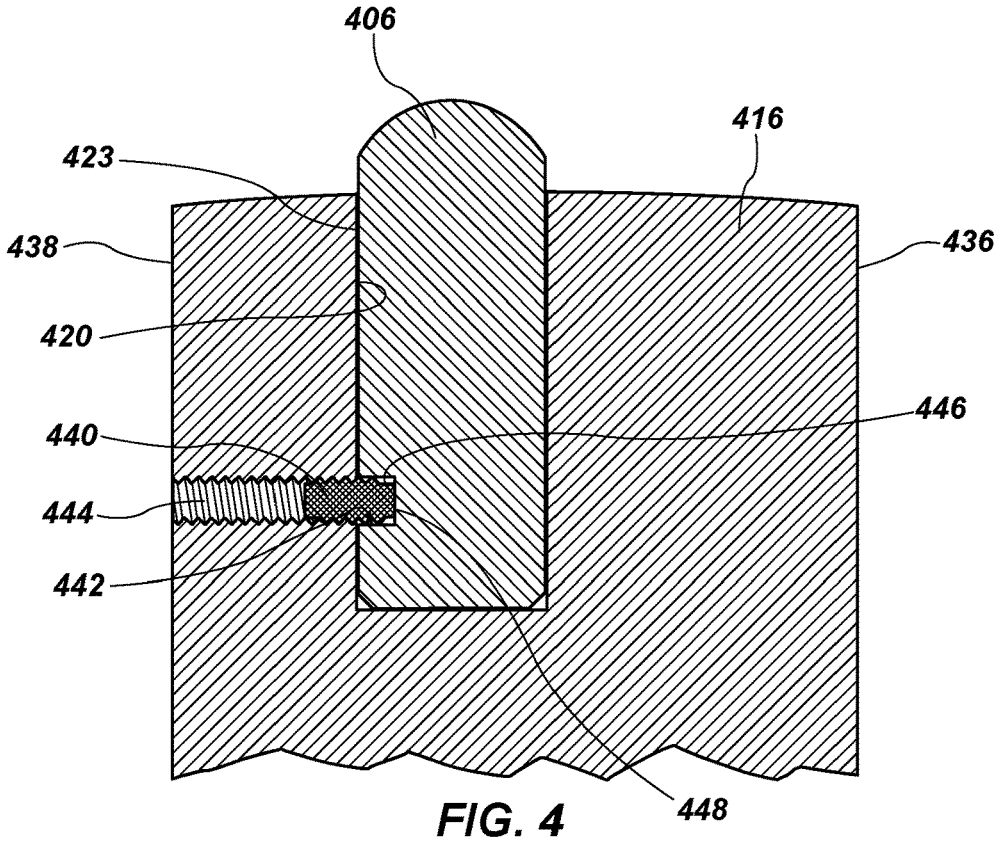
FIG. 4 is a side, cross-sectional view of a formation-engaging structure attached by a threaded fastener to a blade of an earth-boring tool, according to an embodiment of the present disclosure.

FIG. 4 illustrates an embodiment of a formation-engaging structure 406 attached to a blade 416 of an earth-boring tool by a threaded fastening element, such as a set screw 440. The formation-engaging structure 406 may be received within a pocket 420 of the blade 416, as previously described. A receiving formation 442 may optionally be formed in a sidewall 423 of the formation-engaging structure 406 and may be substantially aligned with a tapped bore 444 extending through the blade 416 from a rotationally trailing surface 438 of the blade 416 to the pocket 420; however, in other embodiments, the tapped bore 444 may extend from a rotationally leading surface 436 of the blade 416. The receiving formation 442 may include a blind bore terminating at a recessed receiving surface 446, which may optionally be planar. The set screw 440 may be threaded within the tapped bore 444 until a leading end 448 of the set screw 440 engages the receiving surface 446 of the receiving formation 442 of the formation-engaging structure 406. The leading end 448 of the set screw 440 and the receiving formation 442 of the formation-engaging structure 406 may be correspondingly sized and configured to rigidly retain the formation-engaging structure 406 within the pocket 420. In other embodiments, the formation-engaging structure 406 need not have a recessed receiving formation; in such embodiments, the leading end 448 of the set screw 440 may abut the sidewall 423 of the formation-engaging structure 406 with sufficient force to retain the formation-engaging structure 406 within the pocket 420.

Figure 5:
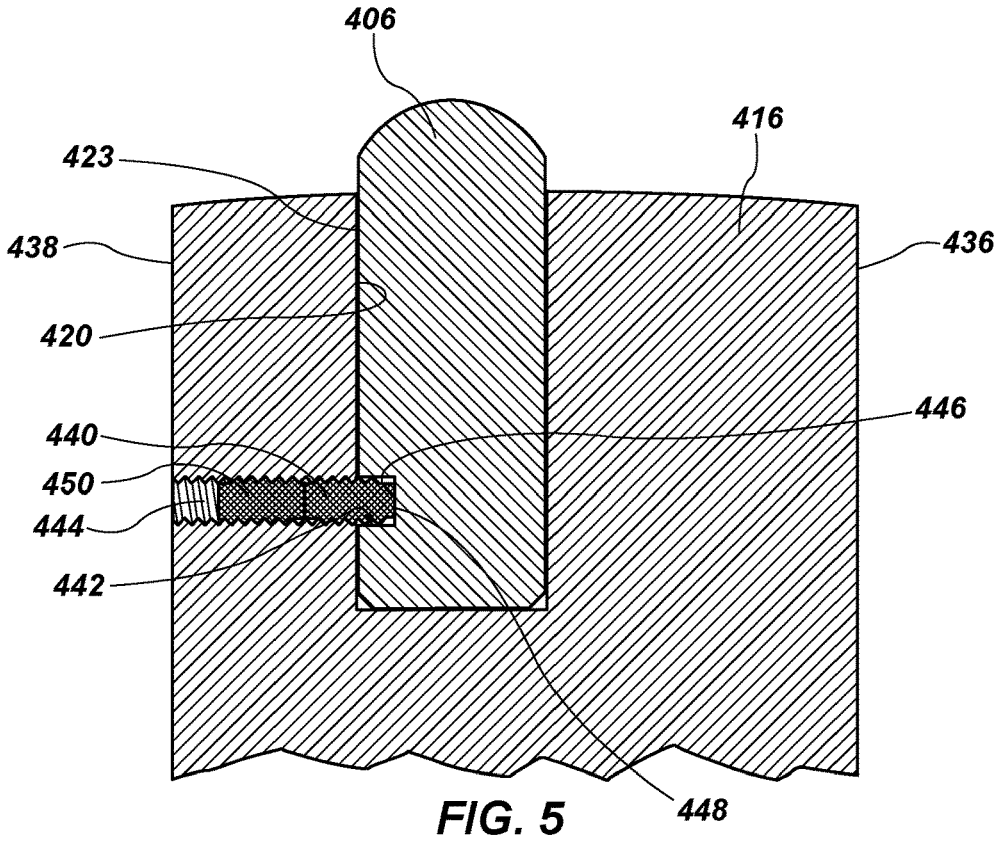
FIG. 5 is a side, cross-sectional view of a formation-engaging structure attached by a first threaded fastener to a blade of an earth-boring tool, with a second threaded fastener retaining the first threaded fastener in place, according to an embodiment of the present disclosure.

It is to be appreciated that, during an earth-boring operation, the drill string (not shown), and an earth-boring tool coupled thereto, may experience significant amounts of vibration and other disruptive phenomena, which may, in some instances, over time, cause the set screw 440 to counter-rotate within the tapped bore 444 (i.e., unscrew) from the position rigidly retaining the formation-engaging structure 406 within the pocket 420. As shown in FIG. 5, to prevent such unwanted unscrewing of the set screw 440, a second set screw 450 may be threaded within the tapped bore 444 until a leading end of the second set screw abuts a trailing end of the first set screw 440 in a manner retaining the first set screw 440 in the position rigidly retaining the formation-engaging structure 406 with the pocket 420. The presence of the second set screw 450 may effectively prolong the retention capabilities of the first set screw 440, particularly in earth-boring operations resulting in high amounts of vibration on the earth-boring tool and/or on the formation-engaging structure 406.

Figure 6:
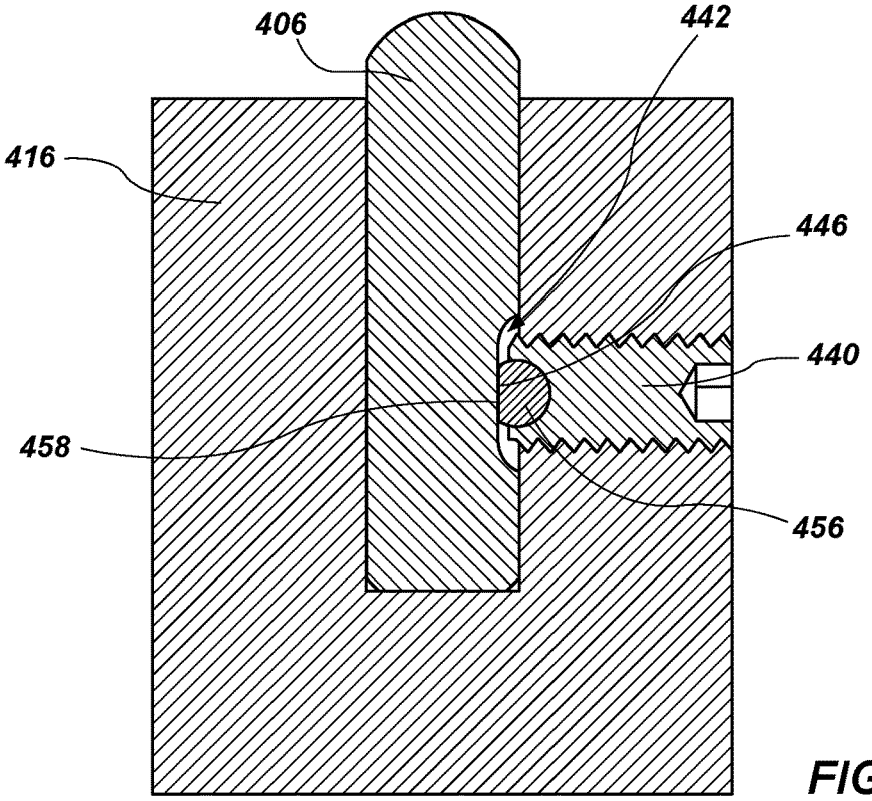
FIG. 6 is a side, partial cross-sectional view of a formation-engaging structure configured to be attached by a threaded fastener to a blade of an earth-boring tool, the threaded fastener having a swivel tip configured to engage a corresponding receiving formation formed in a sidewall of the formation-engaging structure, according to an embodiment of the present disclosure.
Figure 7:
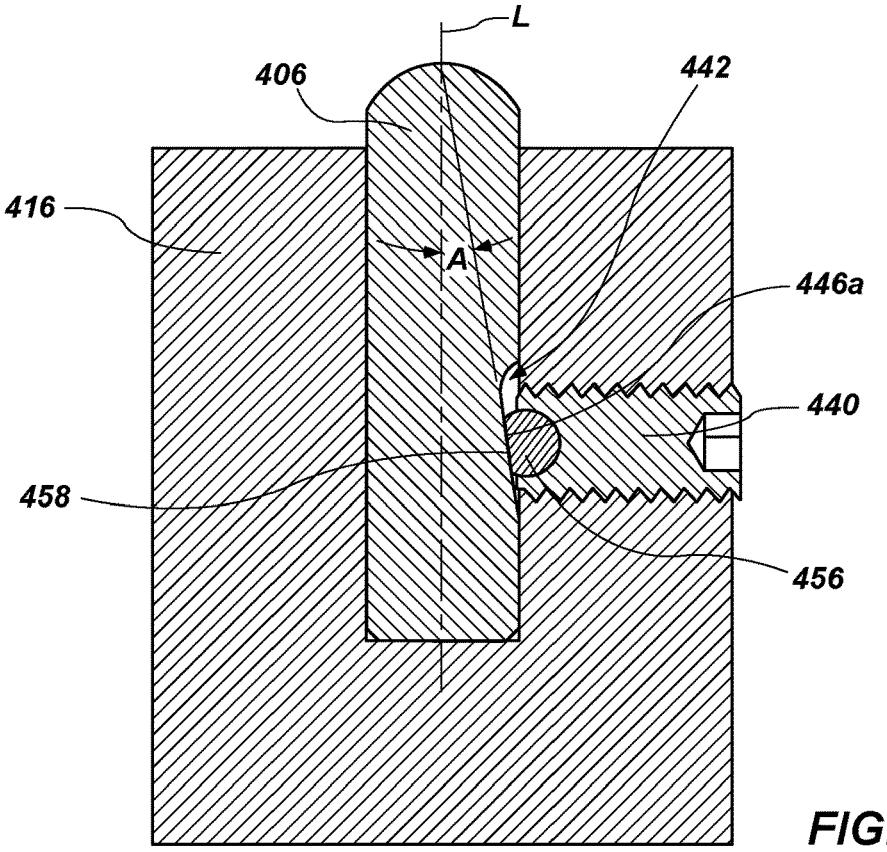
FIG. 7 is a side, partial cross-sectional view of a formation-engaging structure similar to that shown in FIG. 6, wherein the receiving formation in the sidewall of the formation-engaging structure includes an inclined surface, and the swivel tip of the threaded fastener is configured to engage the inclined receiving surface, according to an embodiment of the present disclosure.

In other embodiments, as shown in FIG. 6, the set screw 440 may comprise what is termed a "swivel tip" set screw, having a tip 456 with a bearing surface 458. The tip 456 may be capable of swiveling relative to the remainder of the set screw 440 in a manner to self-orient the bearing surface 458 with the receiving surface 446 of the receiving formation 442 when the set screw 440 is threaded into place against the planar receiving surface 446. As shown, the bearing surface 458 of the tip 456 of the set screw 440 and the receiving surface 446 of the receiving formation 442 of the formation-engaging structure 406 may each be planar; however, in other embodiments, other configurations are possible. In further embodiments, as shown in FIG. 7, the receiving formation 442 of the formation-engaging structure 406 may include a planar receiving surface **446*a* oriented at an inclined angle A relative to a longitudinal axis L of the formation-engaging structure 406. In such embodiments, the bearing surface 458 of the tip 456 of the swivel-tip set screw 440 may also be planar and the tip 456 may swivel to self-orient the planar bearing surface 458 to be co-planar with the inclined receiving surface 446*a* of the receiving formation 442 when the set screw 440 is threaded into place against the inclined receiving surface 446*a***.

Figure 8:
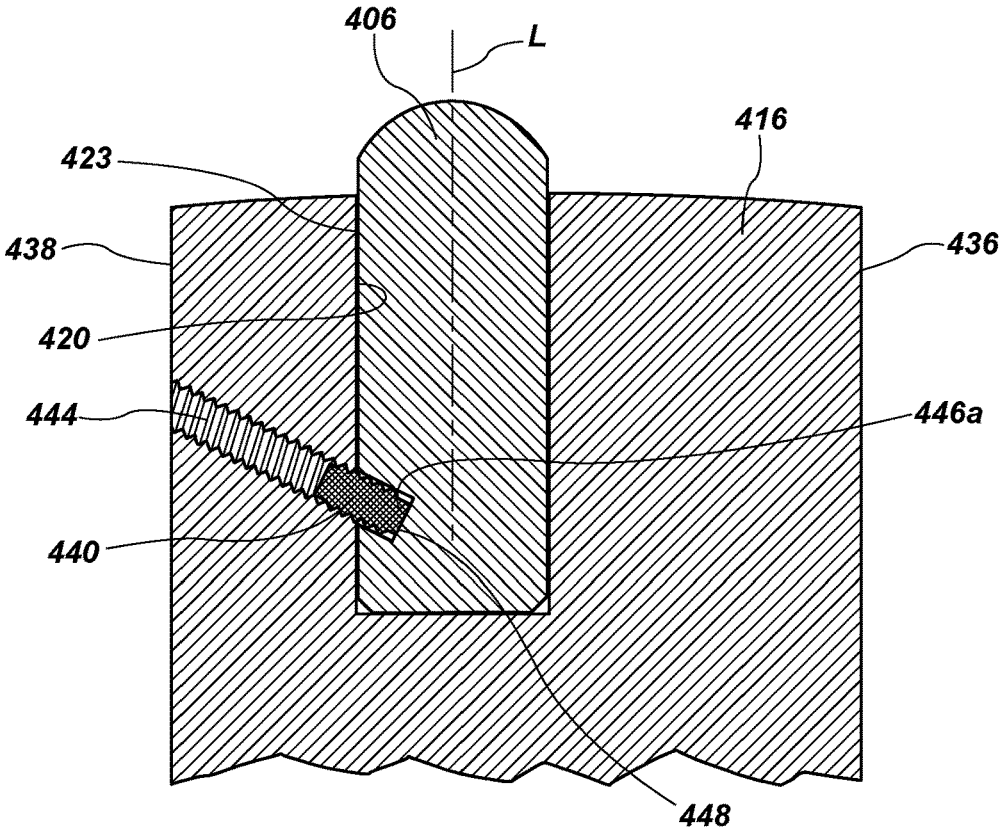
FIG. 8 is a side, cross-sectional view of a formation-engaging structure attached by a threaded fastener to a blade of an earth-boring tool, the threaded fastener oriented at an angle with respect to a longitudinal axis of the formation-engaging structure, according to an embodiment of the present disclosure.

In additional embodiments, at shown in FIG. 8, the receiving surface **446*a* of the receiving formation 442 of the formation-engaging structure 406 may be planar and inclined at an angle A relative to the longitudinal axis L of the formation-engaging structure 406 and the tapped bore 444 may extend through the blade 416 at an angle relative to the longitudinal axis L of the formation-engaging structure 406 and substantially perpendicular to the inclined, recessed receiving surface 446*a*. In such embodiments, the receiving formation 442 in the sidewall 423 of the formation-engaging structure 406 may be substantially aligned with and oriented at the same angle as the tapped bore 444. It is to be appreciated that the orientation of the inclined, planar receiving surface 446*a* of the receiving formation 442 shown in FIGS. 7 and 8 may increase the retaining force into the blade on the formation-engaging structure 406**.

Figure 9:
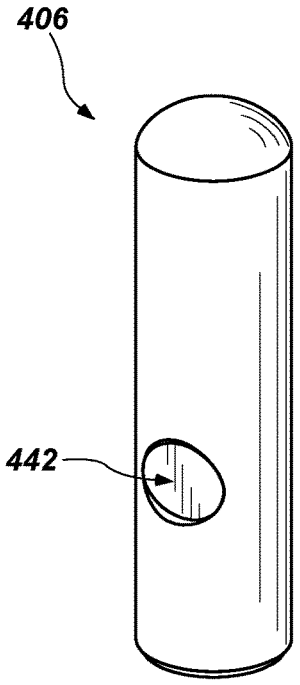
FIG. 9 is a perspective view of the formation-engaging structure shown in FIGS. 4 and 5.
Figure 10:
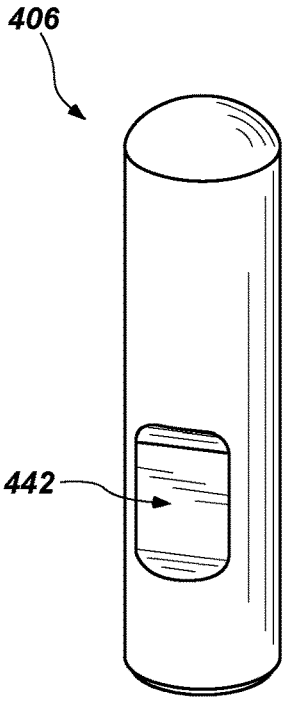
FIG. 10 is a perspective view of the formation-engaging structure shown in FIG. 6.
Figure 11:
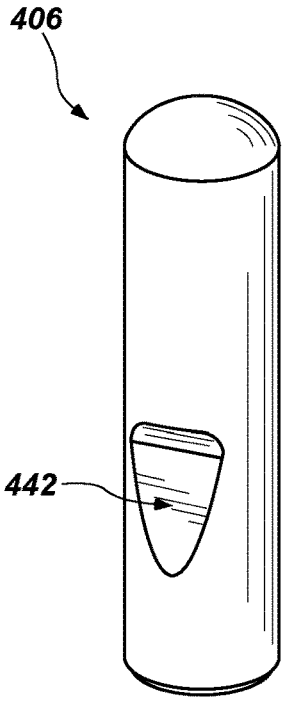
FIG. 11 is a perspective view of the formation-engaging structure shown in FIG. 7.

For reference, FIG. 9 illustrates a perspective view of the receiving formation 442 of the formation-engaging structure 406 shown in FIGS. 4 and 5; FIG. 10 illustrates a perspective view of the receiving formation 442 of the formation-engaging structure 406 shown in FIG. 6; and FIG. 11 illustrates a perspective view of the receiving formation 442 of the formation-engaging structure 406 shown in FIG. 7. FIG. 11 illustrates a perspective view of the receiving formation. It is to be appreciated that the configurations and orientations of the receiving formations 442 of the formation-engaging structures 406 of the present disclosure are not limited to those described in relation to FIGS. 4 through 11.

It is to be appreciated that, while the foregoing embodiments disclose retaining features for retaining the formation-engaging structures to blades of an earth-boring tool, the retaining features may also be incorporated to retain formation-engaging structures on an earth-boring tool lacking blades.

Although the foregoing description contains many specifics, these are not to be construed as limiting the scope of the present invention, but merely as providing certain exemplary embodiments. Similarly, other embodiments of the invention may be devised that do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. An earth-boring tool, comprising:

at least one blade located on a body of the earth-boring tool;

cutting elements positioned in respective cutting element pockets on an exposed outer surface of the at least one blade, wherein the cutting elements comprise a polycrystalline diamond compact;

a pocket opening onto the exposed outer surface of the at least one blade;

a tapped bore extending through the at least one blade from at least one of a rotationally leading surface and a rotationally trailing surface of the at least one blade to the pocket, the rotationally leading surface being a leading surface of the blade as the at least one blade rotates around an axis of rotation of the body of the earth-boring tool, the rotationally trailing surface being a trailing surface of the blade as the at least one blade rotates around the axis of rotation of the body of the earth-boring tool;

a formation-engaging structure received within the pocket of the at least one blade, the formation-engaging structure positioned intermediate at least two cutting elements along a radial axis of the body of the earth-boring tool, the formation-engaging structure having a distal end, a proximal end and a sidewall therebetween, and the distal end of the formation-engaging structure having a formation-engaging surface;

a receiving formation located in the sidewall of the formation-engaging structure; and a threaded fastening element threaded within the tapped bore extending through the at least one blade, the threaded fastening element threadably engaging threads of the tapped bore, a first end of the threaded fastening element engaging the receiving formation of the formation-engaging structure, the threaded fastening element, as engaged, configured to retain the formation-engaging structure within the pocket of the at least one blade.

2. The earth-boring tool of claim 1, wherein the receiving formation comprises a receiving surface configured to engage the first end of the threaded fastening element.

3. The earth-boring tool of claim 2, wherein the receiving surface is oriented at a non-parallel angle in relation to a longitudinal axis of the formation-engaging structure.

4. The earth-boring tool of claim 3, wherein the tapped bore is oriented at a non-perpendicular angle in relation to the longitudinal axis of the formation-engaging structure.

5. The earth-boring tool of claim 3, wherein the receiving surface of the receiving formation is planar, and the threaded fastening element comprises a set screw with a swivel tip having a planar bearing surface oriented co-planar with the receiving surface.

6. The earth-boring tool of claim 1, further comprising a second threaded fastening element threaded within the tapped bore, a second end of the threaded fastening element adjacent a first end of the second threaded fastening element, the second threaded fastening element retaining the threaded fastening element within the tapped bore.

7. The earth-boring tool of claim 1, wherein the formation-engaging surface of the formation-engaging structure is ovoid.

8. The earth-boring tool of claim 1, wherein the formation-engaging structure comprises a volume of superabrasive material disposed over a substrate, the formation-engaging surface comprising a surface of the volume of superabrasive material.

9. The earth-boring tool of claim 8, wherein the volume of superabrasive material of the formation-engaging structure comprises polycrystalline diamond.

10. The earth-boring tool of claim 2, wherein an outer surface of the receiving surface of the receiving formation is recessed relative to an outer surface of the sidewall of the formation-engaging structure.

11. The earth-boring tool of claim 1, wherein the cutting elements are located on the rotationally leading surface of the at least one blade and the formation-engaging structure is located rotationally behind the cutting elements.

12. The earth-boring tool of claim 1, wherein the formation-engaging structure is located at a rotationally leading position relative to the cutting elements.

13. The earth-boring tool of claim 1, wherein the formation-engaging structure is an insert.

14. The earth-boring tool of claim 1, wherein the formation-engaging structure is a non-cutting bearing element positioned and oriented on the body as a rubbing surface configured to rub against a formation as the body of the earth-boring tool is rotated within a wellbore.

15. The earth-boring tool of claim 1, wherein the earth-boring tool comprises a fixed-cutter earth-boring rotary drill bit comprising a bit body having generally radially projecting and longitudinally extending blades, the pocket being located on a leading end of a respective blade.

16. The earth-boring tool of claim 1, wherein the tapped bore comprises a blind bore extending through the at least one blade from the rotationally trailing surface of the at least one blade to the pocket.

17. The earth-boring tool of claim 1, wherein each of the threaded fastening element and the receiving formation of the formation-engaging structure are sized and configured to rigidly retain the formation-engaging structure within the pocket of the at least one blade.

18. The earth-boring tool of claim 1, wherein the formation-engaging surface of the formation-engaging structure comprises a wear-resistant material comprising cemented tungsten carbide.

* * * * *